US007481163B2

(12) United States Patent
Theilacker

(10) Patent No.: US 7,481,163 B2
(45) Date of Patent: Jan. 27, 2009

(54) METHOD FOR CONTROLLING THE CUT REGISTER IN A WEB-FED ROTARY PRESS

(75) Inventor: Klaus Theilacker, Friedberg-Rederzhausen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 466 days.

(21) Appl. No.: 11/254,921

(22) Filed: Oct. 20, 2005

(65) Prior Publication Data

US 2006/0102026 A1 May 18, 2006

(30) Foreign Application Priority Data

Oct. 23, 2004 (DE) ..... 10 2004 051 634

(51) Int. Cl.
*B41F 13/56* (2006.01)

(52) U.S. Cl. ..... 101/226; 101/485; 101/227

(58) Field of Classification Search ..... 101/226
See application file for complete search history.

(56) References Cited

U.S. PATENT DOCUMENTS 2,963,965 A * 12/1960 Baumgartner ..... 101/227
5,458,062 A * 10/1995 Goldberg et al. ..... 101/485
6,092,466 A * 7/2000 Koch et al. ..... 101/485
7,162,954 B1 * 1/2007 Helfenstein et al. ..... 101/226
2005/0247220 A1 11/2005 Brandenburg et al.
2006/0230968 A1 10/2006 Brandenburg et al.

FOREIGN PATENT DOCUMENTS

DE 199 36 291 3/2001
DE 102 45 962 4/2004
DE 103 35 886 3/2005

OTHER PUBLICATIONS

German Office Action dated May 4, 2006 issued in corresponding foreign application No. 10 2004 051 634.0.
German Office Action dated May 4, 2006 issued in corresponding foreign application No. 10 2004 051 635.9.

* cited by examiner

*Primary Examiner*—Leslie J Evanisko
(74) *Attorney, Agent, or Firm*—Cohen Pontani Lieberman & Pavane LLP

(57) ABSTRACT

In a method for controlling the cut register in a web-fed rotary press, in which the position of the cut in at least one printing material web is set by adjusting the rotational speed of at least one pull unit conveying the printing material web, the rotational speed change carried out on the pull unit is also carried out simultaneously on all the pull units that follow in relation to the running direction of the printing material web and convey only this printing material web. The first pull unit whose rotational speed is adjusted is preferably a printing unit of the press unit printing the printing material web.

3 Claims, 1 Drawing Sheet

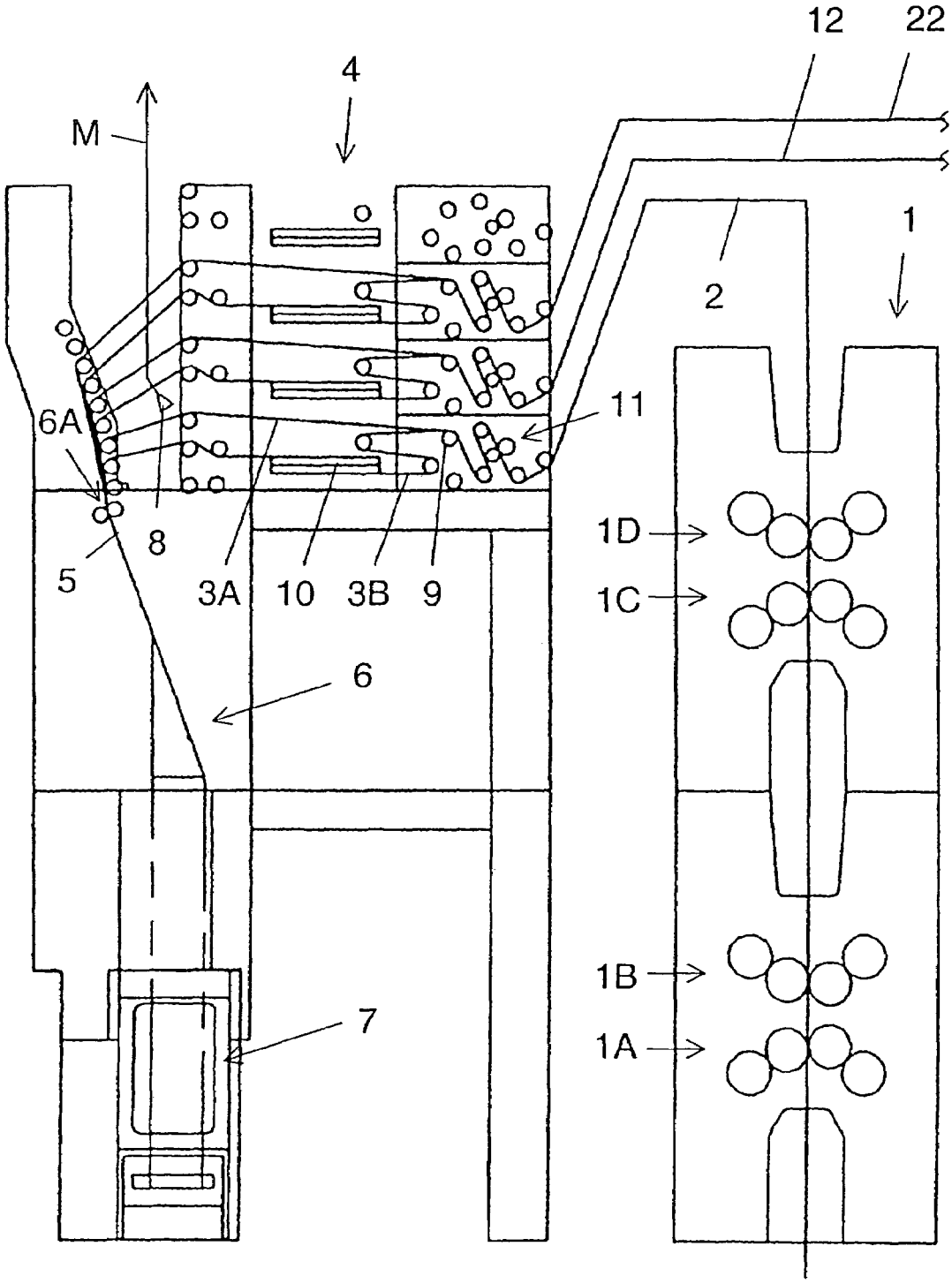
12
22
4
M
1
2
11
6A
8
5
3A
10
3B
9
1D
1C
6
1B
7
1A

METHOD FOR CONTROLLING THE CUT REGISTER IN A WEB-FED ROTARY PRESS

BACKGROUND OF THE INVENTION

The invention relates to a method for controlling the cut register in a web-fed rotary press.

DE 102 45 962 A1 describes a method for controlling the cut register in a web-fed rotary press in which a printing material web, after leaving the last printing unit, is led over pull units each having an adjustable lead to a cross-cutting device, the circumferential speed of one of the pull units being changed in order to adjust the cut register. As compared with setting the cut register by means of a deflection roll that can be displaced or pivoted transversely with respect to the transport direction of the printing material web, this procedure has the advantage of a shorter setting time.

SUMMARY OF THE INVENTION

An object of the present invention is to improve the known method by improving the control loop dynamics and by simplification.

According to the invention, this object is achieved by a method for controlling the cut register in a web-fed rotary press, comprising the steps of setting a position of a cut in a printing material web by adjusting the circumferential speed of at least one pull unit conveying the printing material web and simultaneously adjusting the circumferential speed on all pull units downstream of the at least one pull unit in the running direction of the printing material web that convey only the printing material web or only a portion of the printing material web.

Because the same change in the circumferential speed is carried out simultaneously in all pull units which follow a pull unit used for setting the cut register in the running direction of the printing material web, the adjustment of the cut register in the running direction of the printing material web is not propagated at the transport speed of the web but approximately at the speed of sound given within the printing material, which is approximately two orders of magnitude higher than the usual transport speed of a printing material web in a press. It is obvious that this means a considerable improvement in the control loop dynamics.

It is particularly advantageous if the pull unit used for setting the cut register is already in the printing unit, that is to say the printing units themselves are already adjusted in order to displace the printed image to achieve the desired cut position. With the control of the cut register error, a start is therefore made where it begins to arise, which means that the use of deflection rolls for setting the cut register can be reduced to a minimum.

The principle according to the invention can no longer be applied to a pull unit which no longer conveys a web or a part web cut therefrom on its own but a strand of webs that have already been combined. Instead, in the case of such a pull unit, it is necessary to take into account that, in order to maintain the web tension in each individual web or part web running into the strand, it must at every time have a lead with respect to that web or part web having the highest speed. Therefore, the circumferential speed of such a pull unit must correspond to that of the pull units of the web with the instantaneously highest speed, plus a lead.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the following text, an exemplary embodiment of the invention will be described by using the drawing. The single FIGURE is a schematic partial side view of a press according to the present invention.

DETAILED DESCRIPTION OF THE PRESENTLY PREFERRED EMBODIMENTS

According to the sole FIGURE, in a press unit 1, a printing material web 2 is printed which, together with further webs 12 and 22 coming from press units not shown in the figure, runs into the units arranged downstream in a press.

The web 2, just like the webs 12 and 22 coming from the other press units, is initially cut longitudinally into two part webs 3A and 3B. Of the part webs 3A and 3B, one part web 3B is turned in a turner unit 4 before the two part webs 3A and 3B are combined with the part webs cut from the other webs 12 and 22 to form a strand 5 and the latter is folded at a former 6. As a result of the folding at the former 6, the strand 5 is rotated through 90° and then runs to a knife cylinder 7, where it is cross-cut into individual sections. In this case, the position of the cut must be coordinated with the position of the printed image, in order to maintain a constant, predetermined spacing of the printed image from the cut edges in the longitudinal direction.

In order to set the cut register, that is to say the position of the cut in relation to the printed image, the rotational speed of the impression cylinder of the press unit 1 and therefore its circumferential speed is adjusted briefly in order, with a constant path length from the press unit 1 to the knife cylinder 7, to displace the printed image with respect to the position of the cut. This has the advantage that additional cut register setting elements in the form of displaceable rolls are not needed for all the part webs but at most for the part webs turned in the turner unit 4, such as the part web 3B.

In order to control the cut register, before the entry to the folder, that is to say before the combining of the part webs to form a strand 5, an optical sensor 8 is arranged for each part web 3A, 3B, which registers the position of a cut register mark on the part web 3A, 3B and outputs a respective measured signal M. For example, the knife cylinder 7 can be equipped with an incremental encoder, which supplies a clock signal with a predefined number of pulses and a reference pulse for each revolution of the knife cylinder. In this case, when the cut register mark occurs at the sensor 8, the number of such pulses generated up to that point since the last reference pulse can be used as a measure of the position of the cut register mark. A position of a cut register mark measured in this way represents a measure of the actual value of the position of the cut, that is to say of the spacing to be expected of the cut from the mark, and can be used to control the cut register of the respective printing material web.

It goes without saying that an adjustment of the rotational speed of the impression cylinders in the press unit 1 in order to adjust the cut register has to be carried out synchronously in all four printing units 1A, 1B, 1C and 1D of the press unit 1 in order to maintain the correct setting of the colour register.

However, if only the press unit 1 were to be used for setting the cut register, then the effect of an adjustment would be delayed on the end product by a time interval which would correspond approximately to the ratio of the entire path length of the web 2 from the press unit 1 as far the knife cylinder 7 and the transport speed of the web 2 in the press.

In order to reduce this delay, according to the invention the circumferential speeds of all the further pull units conveying the web 2 on its own are adjusted simultaneously and appropriately. In the example shown in FIG. 1, this relates to the pull unit 11 arranged upstream of the longitudinal cutting device, which results in the cut register adjustment up to that point being propagated in the web 2 approximately at the speed of sound of the printing material, which in the case of paper is of the order of magnitude of 3000 m/s, that is to say far above the transport speed of the web 2. It goes without saying that this principle can be applied to any desired number of further following pull units, provided these pull units all convey only the web 2.

Setting the cut register of the turned part web 3B can require an additional setting element in the form of a displaceable roll since, on the additional path in the turner unit 4, an additional contribution to the error can arise, which necessarily has to be controlled out separately from the control of the part web 3A running in a straight line.

The principle of the invention can no longer be applied to a pull unit which no longer conveys a web 2 or part webs 3A, 3B cut from the latter on their own, such as the pull unit 6A that can be seen in Figure, which conveys the strand 5 to the former 7 after it has been combined, since there is no unambiguous association between the pull unit 6A and an individual web 1, 12 or 22. In the case of such a pull unit 6A acting on an entire strand 5, it is necessary to take into account that, in order to maintain the web tension in each individual web or part web running into the strand 5, it must at every time have a lead with respect to that web or part web having the instantaneously highest speed.

If, for example, at a specific time the straight part web 3A just cut from the web 2 is accelerated by means of a synchronous increase in the speed of the printing units 1A to 1D and the pull unit 11 in order to correct the cut register error such that it is instantaneously the web with the highest speed within this strand 5, then the speed of the pull unit 6A must be increased such that, as compared with the last preceding pull unit which acts on the part web 3A, it has the necessary lead to maintain the intended tension in the part web 3A. If the part web 3A subsequently experiences a retardation by the printing units 1A to 1D and the pull unit 11 in order to correct the cut register error in the other direction, so that another web running into the strand 5 instantaneously runs faster, then the speed of the pull unit 6A must be matched to the instantaneously fastest of the other webs.

Although it appears to be extremely expedient to begin in the press unit with the synchronous speed adjustment according to the invention of successive pull units, in principle an application only after the press unit is also conceivable and covered by the protection of the patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling the cut register in a web-fed rotary press, comprising the steps of:

setting a position of a cut in a printing material web by adjusting the circumferential speed of at least one pull unit conveying the printing material web; and simultaneously adjusting the circumferential speed on all pull units downstream of the at least one pull unit in the running direction of the printing material web that convey only the printing material web or only a portion of the printing material web.

2. The method for controlling the cut register of claim 1, wherein the at least one pull unit is a first printing unit of a press unit printing the printing material web.

3. The method for controlling the cut register of claim 1, wherein a plurality of printing material webs or part webs cut longitudinally therefrom are combined to form a strand in the web-fed rotary press, said method further comprising setting a circumferential speed of a pull unit which conveys the strand after said plural printing material webs or part webs have been combined in accordance with the preceding pull units of one web or part web of the strand that has an instantaneously highest speed of all the plurality of webs or part webs running into the strand.

* * * * *